US010295190B2

(12) United States Patent
Boardman et al.

(10) Patent No.: US 10,295,190 B2
(45) Date of Patent: May 21, 2019

(54) CENTERBODY INJECTOR MINI MIXER FUEL NOZZLE ASSEMBLY

(71) Applicant: General Electric Company, Schenectady, NY (US)

(72) Inventors: Gregory Allen Boardman, Liberty Township, OH (US); Pradeep Naik, Bangalore (IN); Manampathy Gangadharan Giridharan, Mason, OH (US); David Albin Lind, Lebanon, OH (US); Jeffrey Michael Martini, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 370 days.

(21) Appl. No.: 15/343,601

(22) Filed: Nov. 4, 2016

(65) Prior Publication Data

US 2018/0128489 A1 May 10, 2018

(51) Int. Cl.
*F23R 3/28* (2006.01)
*F23R 3/10* (2006.01)

(52) U.S. Cl.
CPC ..... *F23R 3/286* (2013.01); *F23R 3/10* (2013.01); *F23R 3/28* (2013.01); *F05D 2220/32* (2013.01)

(58) Field of Classification Search
CPC .... F23R 3/286; F23R 3/04; F23R 3/10; F23R 3/28
See application file for complete search history.

(56) References Cited

U.S. PATENT DOCUMENTS 3,917,173 A 11/1975 Singh
4,100,733 A 7/1978 Striebel et al.
(Continued)

OTHER PUBLICATIONS

Srinivasan et al., "Improving low load combustion, stability, and emissions in pilot-ignited natural gas engines", Journal of Automobile Engineering, Sage journals, vol. 220, No. 2, pp. 229-239, Feb. 1, 2006.

(Continued)

*Primary Examiner* — Steven M Sutherland
(74) *Attorney, Agent, or Firm* — Dority & Manning, P.A.

(57) ABSTRACT

The present disclosure is directed to a fuel injector for a gas turbine engine including an end wall defining a fluid chamber, a centerbody, and an outer sleeve surrounding the centerbody from the end wall toward a downstream end of the fuel injector. The centerbody includes an axially extended outer wall and inner wall. The outer wall and inner wall extend from the end wall toward the downstream end of the fuel injector. The outer wall, the inner wall, and the end wall together define a fluid conduit extended in a first direction toward the downstream end of the fuel injector and in a second direction toward an upstream end of the fuel injector. The fluid conduit is in fluid communication with the fluid chamber. The outer wall defines at least one radially oriented fluid injection port in fluid communication with the fluid conduit. The outer sleeve and the centerbody define a premix passage radially therebetween and an outlet at the downstream end of the premix passage. The outer sleeve defines a plurality of radially oriented first air inlet ports in circumferential arrangement at a first axial portion of the outer sleeve. The outer sleeve defines a plurality of radially oriented second air inlet ports in circumferential arrangement at a second axial portion of the outer sleeve.

20 Claims, 7 Drawing Sheets

(56) References Cited

U.S. PATENT DOCUMENTS

| | | | | |
|---|---|---|---|---|
| 4,177,637 | A | 12/1979 | Pask | |
| 4,408,461 | A | 10/1983 | Bruhwiler et al. | |
| 4,412,414 | A | 11/1983 | Novick et al. | |
| 4,689,961 | A | 9/1987 | Stratton | |
| 4,967,561 | A | 11/1990 | Bruhwiler et al. | |
| 5,207,064 | A | 5/1993 | Ciokajlo et al. | |
| 5,211,675 | A | 5/1993 | Bardey et al. | |
| 5,265,409 | A | 11/1993 | Smith, Jr. et al. | |
| 5,307,634 | A | 5/1994 | Hu | |
| 5,408,830 | A * | 4/1995 | Lovett | F23D 17/002 239/422 |
| 5,511,375 | A | 4/1996 | Joshi et al. | |
| 5,592,821 | A | 1/1997 | Alary et al. | |
| 5,619,855 | A | 4/1997 | Burrus | |
| 5,622,054 | A | 4/1997 | Tingle | |
| 5,829,967 | A | 11/1998 | Chyou | |
| 5,839,283 | A | 11/1998 | Dobbeling | |
| 5,937,653 | A | 8/1999 | Alary et al. | |
| 6,038,861 | A | 3/2000 | Amos et al. | |
| 6,286,298 | B1 | 9/2001 | Burrus et al. | |
| 6,295,801 | B1 | 10/2001 | Burrus et al. | |
| 6,331,109 | B1 | 12/2001 | Paikert et al. | |
| 6,442,939 | B1 | 9/2002 | Stuttaford et al. | |
| 6,460,339 | B2 | 10/2002 | Nishida et al. | |
| 6,539,721 | B2 | 4/2003 | Oikawa et al. | |
| 6,539,724 | B2 | 4/2003 | Cornwell et al. | |
| 6,564,555 | B2 | 5/2003 | Rice et al. | |
| 6,594,999 | B2 | 7/2003 | Mandai et al. | |
| 6,598,584 | B2 | 7/2003 | Beck et al. | |
| 6,772,594 | B2 | 8/2004 | Nishida et al. | |
| 6,837,050 | B2 | 1/2005 | Mandai et al. | |
| 6,837,051 | B2 | 1/2005 | Mandai et al. | |
| 6,915,637 | B2 | 7/2005 | Nishida et al. | |
| 6,962,055 | B2 | 11/2005 | Chen et al. | |
| 7,036,482 | B2 | 5/2006 | Beck et al. | |
| 7,188,476 | B2 | 3/2007 | Inoue et al. | |
| 7,200,998 | B2 | 4/2007 | Inoue et al. | |
| 7,313,919 | B2 | 1/2008 | Inoue et al. | |
| 7,360,363 | B2 | 4/2008 | Mandai et al. | |
| 7,565,803 | B2 | 7/2009 | Li et al. | |
| 7,677,026 | B2 | 3/2010 | Conete et al. | |
| 7,770,397 | B2 | 8/2010 | Patel et al. | |
| 7,788,929 | B2 | 9/2010 | Biebel et al. | |
| 7,810,333 | B2 | 10/2010 | Kraemer et al. | |
| 7,966,801 | B2 | 6/2011 | Umeh et al. | |
| 8,161,751 | B2 | 4/2012 | Hall | |
| 8,276,385 | B2 | 10/2012 | Zuo et al. | |
| 8,316,644 | B2 | 11/2012 | Wilbraham | |
| 8,322,143 | B2 | 12/2012 | Uhm et al. | |
| 8,424,311 | B2 | 4/2013 | York et al. | |
| 8,511,087 | B2 | 8/2013 | Fox et al. | |
| 8,528,337 | B2 | 9/2013 | Berry et al. | |
| 8,539,773 | B2 | 9/2013 | Ziminsky et al. | |
| 8,590,311 | B2 | 11/2013 | Parsania et al. | |
| 8,621,870 | B2 | 1/2014 | Carroni et al. | |
| 8,671,691 | B2 | 3/2014 | Boardman et al. | |
| 8,701,417 | B2 | 4/2014 | Nicholls et al. | |
| 8,863,524 | B2 | 10/2014 | Karlsson et al. | |
| 8,938,971 | B2 | 1/2015 | Poyyapakkam et al. | |
| 8,943,835 | B2 | 2/2015 | Corsmeier et al. | |
| 9,091,444 | B2 | 7/2015 | Turrini et al. | |
| 9,335,050 | B2 | 5/2016 | Cunha et al. | |
| 9,377,192 | B2 | 6/2016 | Hirata et al. | |
| 9,388,985 | B2 | 7/2016 | Wu et al. | |
| 9,416,973 | B2 | 8/2016 | Melton et al. | |
| 9,423,137 | B2 | 8/2016 | Nickolaus | |
| 2003/0101729 | A1 | 6/2003 | Srinivasan | |
| 2011/0016871 | A1 | 1/2011 | Kraemer et al. | |
| 2011/0083439 | A1 | 4/2011 | Zuo et al. | |
| 2011/0252803 | A1 | 10/2011 | Subramanian et al. | |
| 2012/0096866 | A1 | 4/2012 | Khan et al. | |
| 2012/0131923 | A1 | 5/2012 | ELKady et al. | |
| 2012/0285173 | A1 | 11/2012 | Poyyapakkam et al. | |
| 2012/0308947 | A1 * | 12/2012 | Melton | F23R 3/002 431/351 |
| 2013/0042625 | A1 | 2/2013 | Barker et al. | |
| 2013/0199188 | A1 | 8/2013 | Boardman et al. | |
| 2013/0239581 | A1 | 9/2013 | Johnson et al. | |
| 2013/0336759 | A1 | 12/2013 | Christians | |
| 2014/0060060 | A1 | 3/2014 | Bernero et al. | |
| 2014/0290258 | A1 | 10/2014 | Gerendas et al. | |
| 2015/0076251 | A1 | 3/2015 | Berry | |
| 2015/0128607 | A1 | 5/2015 | Lee | |
| 2015/0159875 | A1 | 6/2015 | Berry et al. | |
| 2016/0010856 | A1 | 1/2016 | Biagioli et al. | |
| 2016/0169110 | A1 | 6/2016 | Myers et al. | |
| 2016/0209036 | A1 | 7/2016 | Cheung | |

OTHER PUBLICATIONS

Snyder et al., "Emission and Performance of a Lean-Premixed Gas Fuel Injection System for Aeroderivative Gas Turbine Engines", Journal of Engineering for Gas Turbines and Power, ASME Digital Collection, vol. 118, Issue 1, pp. 38-45, Jan. 1, 1996.

* cited by examiner

CENTERBODY INJECTOR MINI MIXER FUEL NOZZLE ASSEMBLY

FIELD

The present subject matter relates generally to gas turbine engine combustion assemblies. More particularly, the present subject matter relates to a premixing fuel nozzle assembly for gas turbine engine combustors.

BACKGROUND

Aircraft and industrial gas turbine engines include a combustor in which fuel is burned to input energy to the engine cycle. Typical combustors incorporate one or more fuel nozzles whose function is to introduce liquid or gaseous fuel into an air flow stream so that it can atomize and burn. General gas turbine engine combustion design criteria include optimizing the mixture and combustion of a fuel and air to produce high-energy combustion while minimizing emissions such as carbon monoxide, carbon dioxide, nitrous oxides, and unburned hydrocarbons, as well as minimizing combustion tones due, in part, to pressure oscillations during combustion.

However, general gas turbine engine combustion design criteria often produce conflicting and adverse results that must be resolved. For example, a known solution to produce higher-energy combustion is to incorporate an axially oriented vane, or swirler, in serial combination with a fuel injector to improve fuel-air mixing and atomization. However, such a serial combination may produce large combustion swirls or longer flames that may increase primary combustion zone residence time or create longer flames. Such combustion swirls may induce combustion instability, such as increased acoustic pressure dynamics or oscillations (i.e. combustion tones), increased lean blow-out (LBO) risk, or increased noise, or inducing circumferentially localized hot spots (i.e. circumferentially asymmetric temperature profile that may damage a downstream turbine section), or induce structural damage to a combustion section or overall gas turbine engine.

Additionally, larger combustion swirls or longer flames may increase the length of a combustor section. Increasing the length of the combustor generally increases the length of a gas turbine engine or removes design space for other components of a gas turbine engine. Such increases in gas turbine engine length are generally adverse to general gas turbine engine design criteria, such as by increasing weight and packaging of aircraft gas turbine engines and thereby reducing gas turbine engine fuel efficiency and performance.

Therefore, a need exists for a fuel nozzle assembly that may produce high-energy combustion while minimizing emissions, combustion instability, structural wear and performance degradation, and while maintaining or decreasing combustor size.

BRIEF DESCRIPTION

Aspects and advantages of the invention will be set forth in part in the following description, or may be obvious from the description, or may be learned through practice of the invention.

The present disclosure is directed to a fuel injector for a gas turbine engine including an end wall defining a fluid chamber, a centerbody, and an outer sleeve surrounding the centerbody from the end wall toward a downstream end of the fuel injector. The centerbody includes an axially extended outer wall and inner wall. The outer wall and inner wall extend from the end wall toward the downstream end of the fuel injector. The outer wall, the inner wall, and the end wall together define a fluid conduit extended in a first direction toward the downstream end of the fuel injector and in a second direction toward an upstream end of the fuel injector. The fluid conduit is in fluid communication with the fluid chamber. The outer wall defines at least one radially oriented fluid injection port in fluid communication with the fluid conduit. The outer sleeve and the centerbody define a premix passage radially therebetween and an outlet at the downstream end of the premix passage. The outer sleeve defines a plurality of radially oriented first air inlet ports in circumferential arrangement at a first axial portion of the outer sleeve. The outer sleeve defines a plurality of radially oriented second air inlet ports in circumferential arrangement at a second axial portion of the outer sleeve.

A further aspect of the present disclosure is directed to a fuel nozzle for a gas turbine engine including an end wall defining a fluid chamber, a plurality of fuel injectors in axially and radially adjacent arrangement, and an aft wall. The downstream end of the outer sleeve of each fuel injector is connected to the aft wall.

A still further aspect of the present disclosure is directed to a combustor assembly for a gas turbine engine. The combustor assembly includes an inner liner, an outer liner, a bulkhead, and at least one fuel nozzle extended at least partially through the bulkhead. The bulkhead is extended radially between an upstream end of the inner liner and the outer liner. The inner liner is radially spaced from the outer liner with respect to an engine centerline and defines an annular combustion chamber therebetween. The inner liner and the outer liner extend downstream from the bulkhead.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
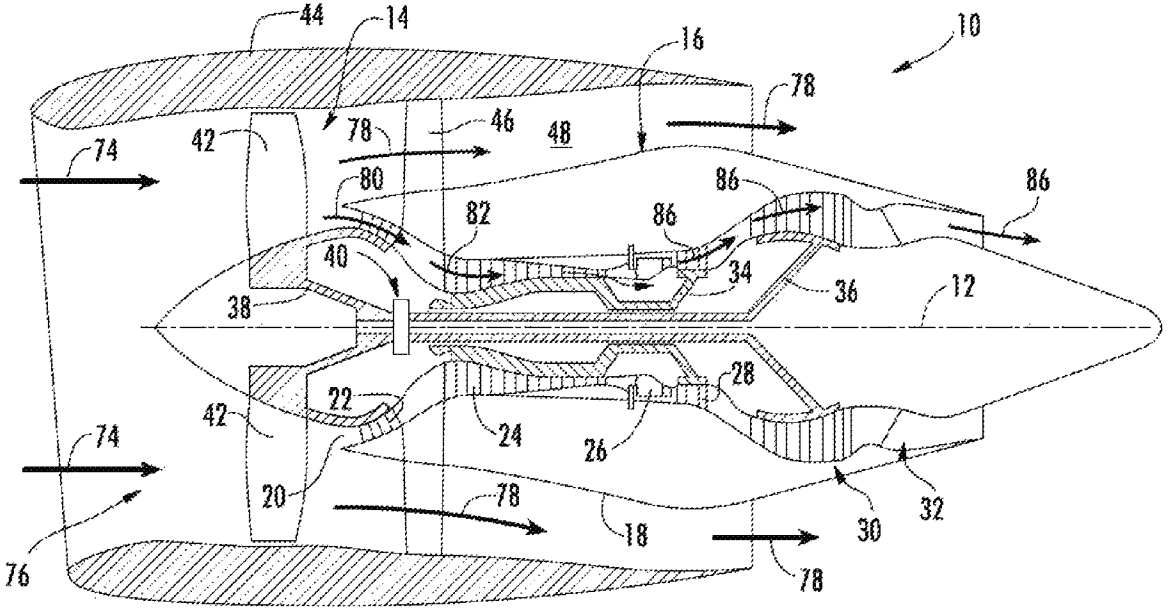
FIG. 1 is a schematic cross sectional view of an exemplary gas turbine engine incorporating an exemplary embodiment of a fuel injector and fuel nozzle assembly.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

A centerbody injector mini mixer fuel injector and nozzle assembly is generally provided that may produce high-energy combustion while minimizing emissions, combustion tones, structural wear and performance degradation, while maintaining or decreasing combustor size. In one embodiment, the serial combination of a radially oriented first air inlet port, a radially oriented fluid injection port, and a radially oriented second air inlet port may provide a compact, non-swirl or low-swirl premixed flame at a higher primary combustion zone temperature producing a higher energy combustion with a shorter flame length while maintaining or reducing emissions outputs. Additionally, the non-swirl or low-swirl premixed flame may mitigate combustor instability (e.g. combustion tones, LBO, hot spots) that may be caused by a breakdown or unsteadiness in a larger flame.

In particular embodiments, the plurality of centerbody injector mini mixer fuel injectors included with a mini mixer fuel nozzle assembly may provide finer combustion dynamics controllability across a circumferential profile of the combustor assembly as well as a radial profile. Combustion dynamics controllability over the circumferential and radial profiles of the combustor assembly may reduce or eliminate hot spots (i.e. provide a more even thermal profile across the circumference of the combustor assembly) that may increase combustor and turbine section structural life.

Referring now to the drawings, FIG. 1 is a schematic partially cross-sectioned side view of an exemplary high by-pass turbofan jet engine 10 herein referred to as "engine 10" as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, the engine 10 has a longitudinal or axial centerline axis 12 that extends there through for reference purposes. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, the engine 10 may further include an intermediate pressure (IP) compressor and turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
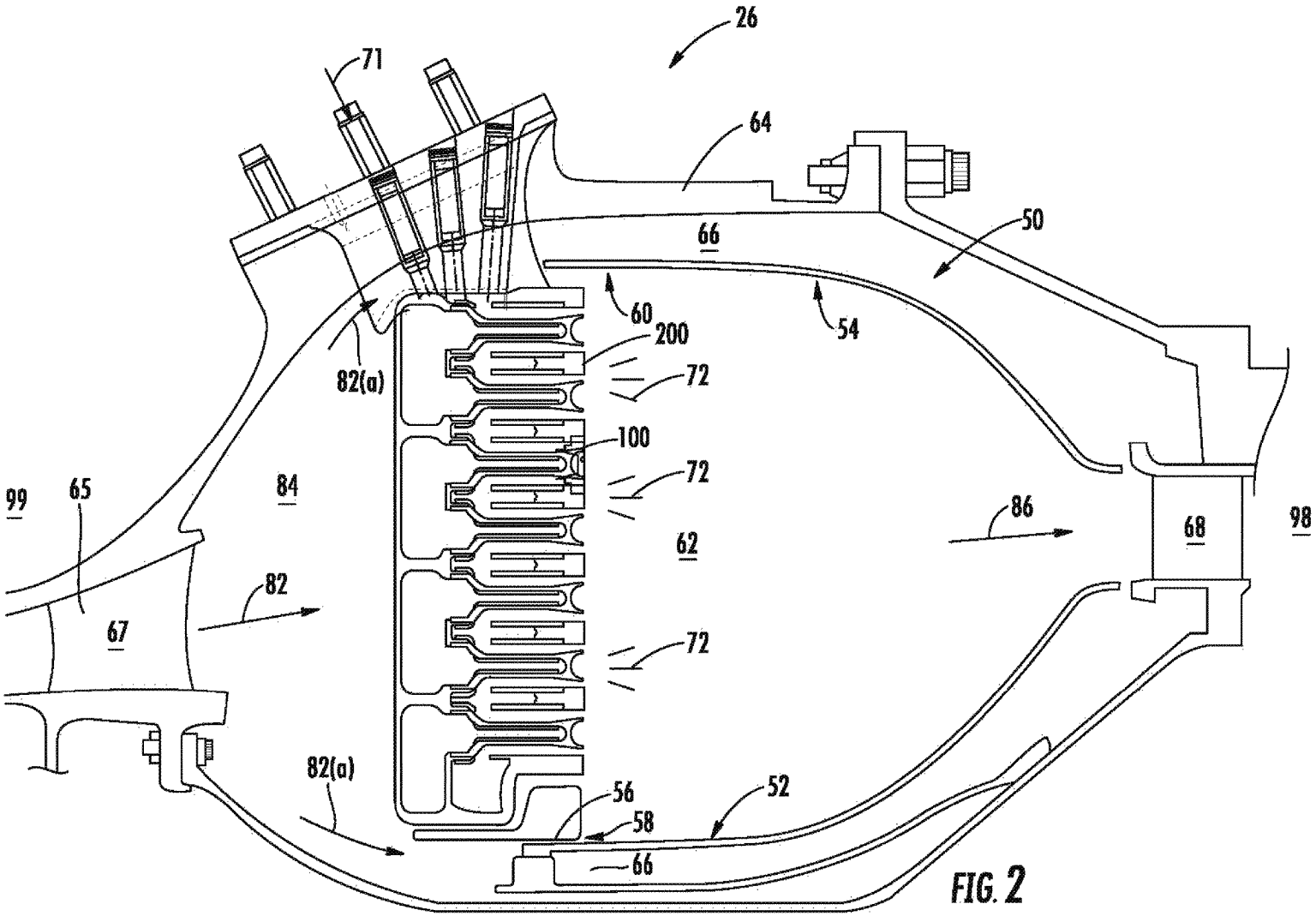
FIG. 2 is an axial cross sectional view of an exemplary embodiment of a combustor assembly of the exemplary engine shown in FIG. 1.

FIG. 2 is a cross sectional side view of an exemplary combustion section 26 of the core engine 16 as shown in FIG. 1. As shown in FIG. 2, the combustion section 26 may generally include an annular type combustor 50 having an annular inner liner 52, an annular outer liner 54 and a bulkhead 56 that extends radially between upstream ends 58, 60 of the inner liner 52 and the outer liner 54 respectfully. In other embodiments of the combustion section 26, the combustion assembly 50 may be a can or can-annular type. As shown in FIG. 2, the inner liner 52 is radially spaced from the outer liner 54 with respect to engine centerline 12 (FIG. 1) and defines a generally annular combustion chamber 62 therebetween. In particular embodiments, the inner liner 52 and/or the outer liner 54 may be at least partially or entirely formed from metal alloys or ceramic matrix composite (CMC) materials.

As shown in FIG. 2, the inner liner 52 and the outer liner 54 may be encased within an outer casing 64. An outer flow passage 66 may be defined around the inner liner 52 and/or the outer liner 54. The inner liner 52 and the outer liner 54 may extend from the bulkhead 56 towards a turbine nozzle or inlet 68 to the HP turbine 28 (FIG. 1), thus at least partially defining a hot gas path between the combustor assembly 50 and the HP turbine 28. A fuel nozzle 200 may extend at least partially through the bulkhead 56 and provide a fuel-air mixture 72 to the combustion chamber 62.

During operation of the engine 10, as shown in FIGS. 1 and 2 collectively, a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48 while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows across a compressor exit guide vane (CEGV) 67 and through a prediffuser 65 into a diffuser cavity or head end portion 84 of the combustion section 26.

The prediffuser 65 and CEGV 67 condition the flow of compressed air 82 to the fuel nozzle 200. The compressed air 82 pressurizes the diffuser cavity 84. The compressed air 82 enters the fuel nozzle 200 and into a plurality of fuel injectors 100 within the fuel nozzle 200 to mix with a fuel 71. The fuel injectors 100 premix fuel 71 and air 82 within the array of fuel injectors with little or no swirl to the resulting fuel-air mixture 72 exiting the fuel nozzle 200. After premixing the fuel 71 and air 82 within the fuel injectors 100, the fuel-air mixture 72 burns from each of the plurality of fuel injectors 100 as an array of compact, tubular flames stabilized from each fuel injector 100.

Typically, the LP and HP compressors 22, 24 provide more compressed air to the diffuser cavity 84 than is needed for combustion. Therefore, a second portion of the compressed air 82 as indicated schematically by arrows 82(*a*) may be used for various purposes other than combustion. For example, as shown in FIG. 2, compressed air 82(*a*) may be routed into the outer flow passage 66 to provide cooling to the inner and outer liners 52, 54. In addition or in the alternative, at least a portion of compressed air 82(*a*) may be routed out of the diffuser cavity 84. For example, a portion of compressed air 82(*a*) may be directed through various flow passages to provide cooling air to at least one of the HP turbine 28 or the LP turbine 30.

Referring back to FIGS. 1 and 2 collectively, the combustion gases 86 generated in the combustion chamber 62 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive thrust.

Figure 3:
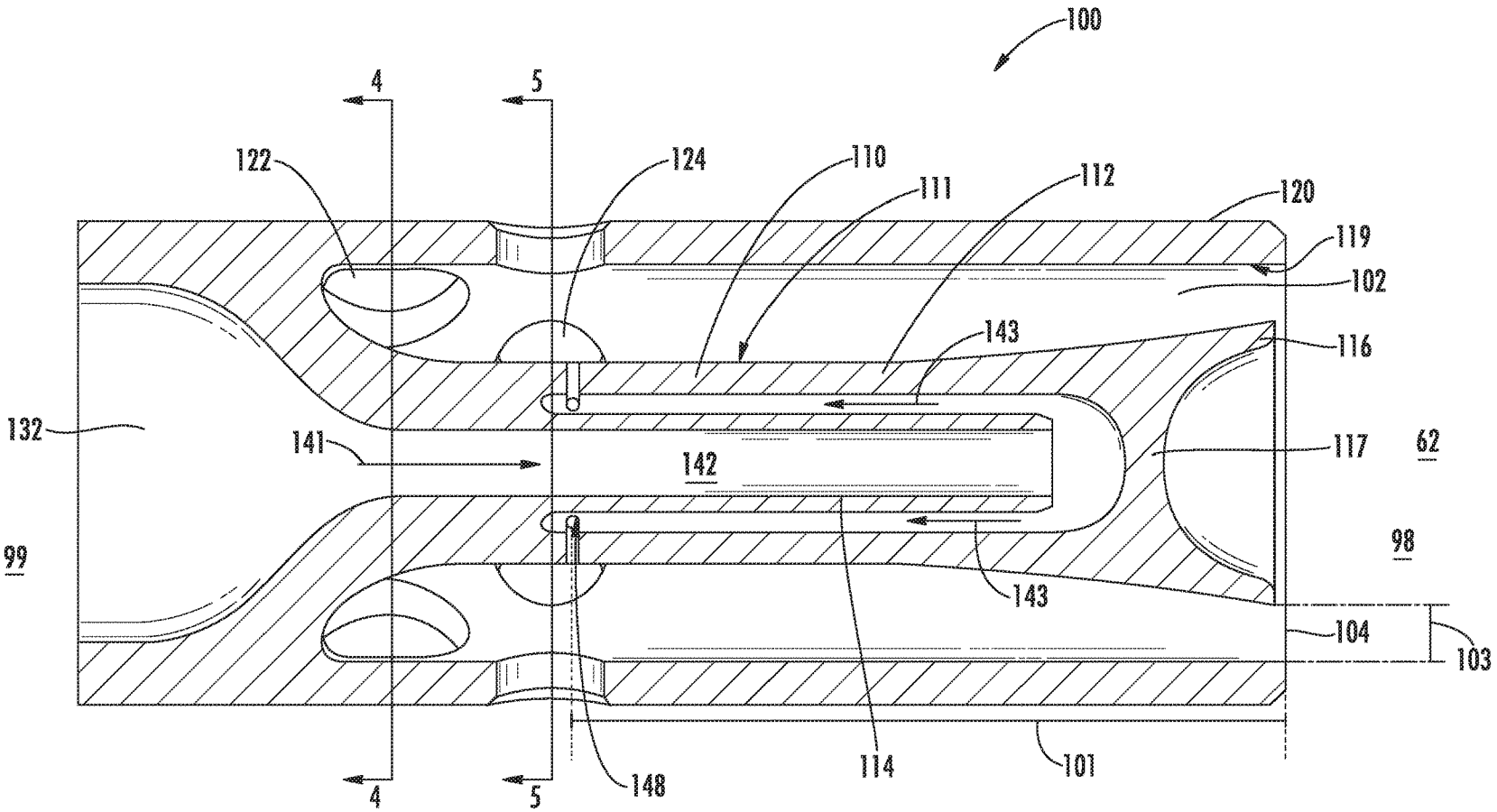
FIG. 3 is an axial cross sectional side view of an exemplary embodiment of a fuel injector for the combustor assembly shown in FIG. 2.

Referring now to FIG. 3, an axial cross sectional side view of an exemplary embodiment of a centerbody injector mini mixer fuel injector 100 (herein referred to as "fuel injector 100") for a gas turbine engine 10 is provided. The fuel injector 100 includes a centerbody 110, an outer sleeve 120, and an end wall 130. The end wall 130 defines a fluid chamber 132. The centerbody 110 includes an axially extended outer wall 112 and an axially extended inner wall 114. The outer wall 112 and the inner wall 114 extend from the end wall 130 toward a downstream end 98 of the fuel injector 100. The outer wall 112, the inner wall 114, and the end wall 130 together define a fluid conduit 142 in fluid communication with the fluid chamber 132. The fluid conduit 142 extends in a first direction 141 toward the downstream end 98 of the fuel injector 100 and in a second direction 143 toward an upstream end 99 of the fuel injector 100. The fluid conduit 142 extended in the second direction 143 may be radially outward within the centerbody 110 of the fluid conduit 142 extended in the first direction 141.

The outer wall 112 of the centerbody 110 defines at least one radially oriented fluid injection port 148 in fluid communication with the fluid conduit 142. The fuel injector 100 may flow a gaseous or liquid fuel, or air, or an inert gas through the fluid conduit 142 and through the fluid injection port 148 into the premix passage 102. The gaseous or liquid fuels may include, but are not limited to, fuel oils, jet fuels propane, ethane, hydrogen, coke oven gas, natural gas, synthesis gas, or combinations thereof.

Figure 4:
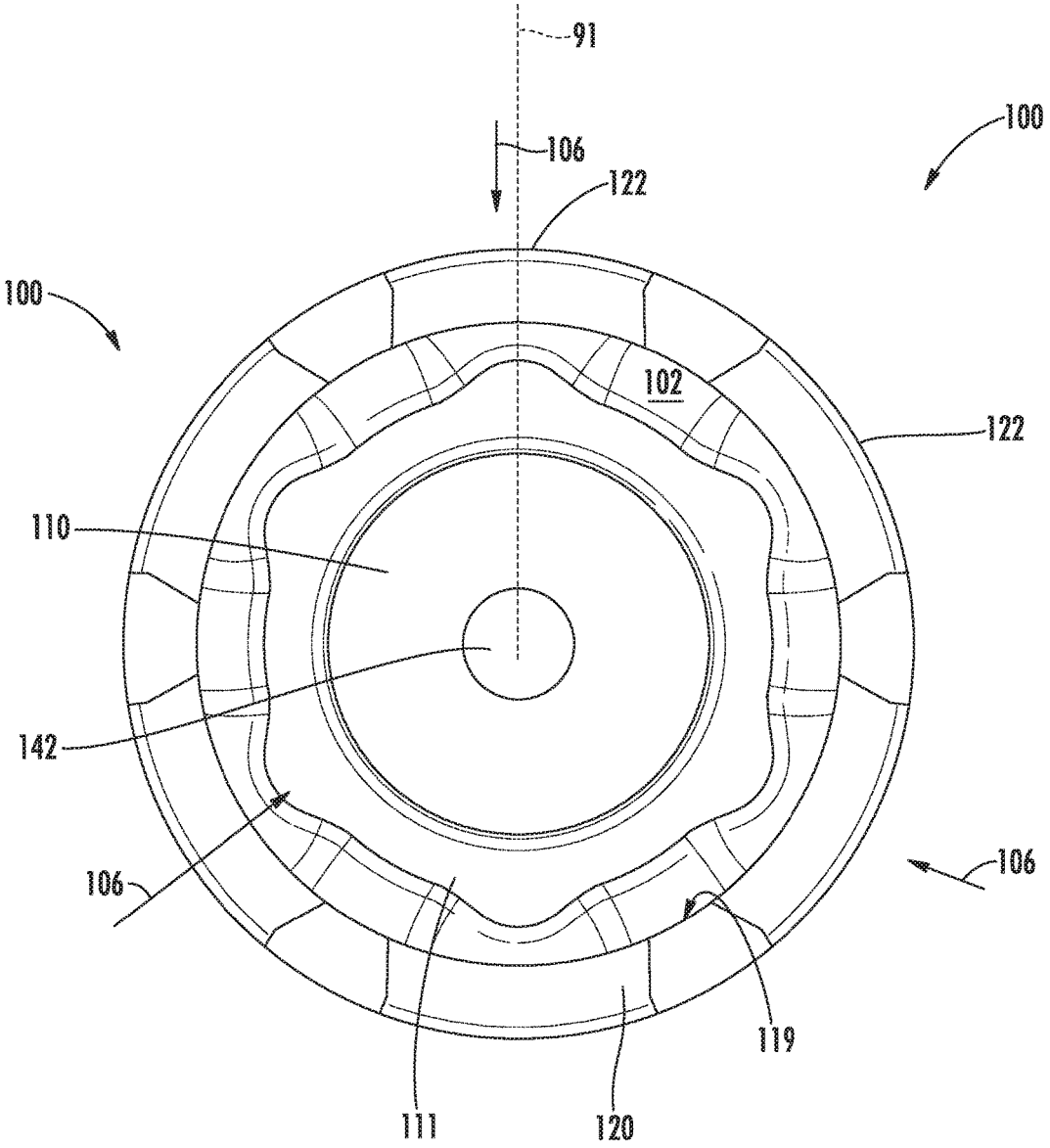
FIG. 4 is a cross sectional view of the exemplary embodiment of the fuel injector shown in FIG. 3 at plane 4-4.
Figure 5:
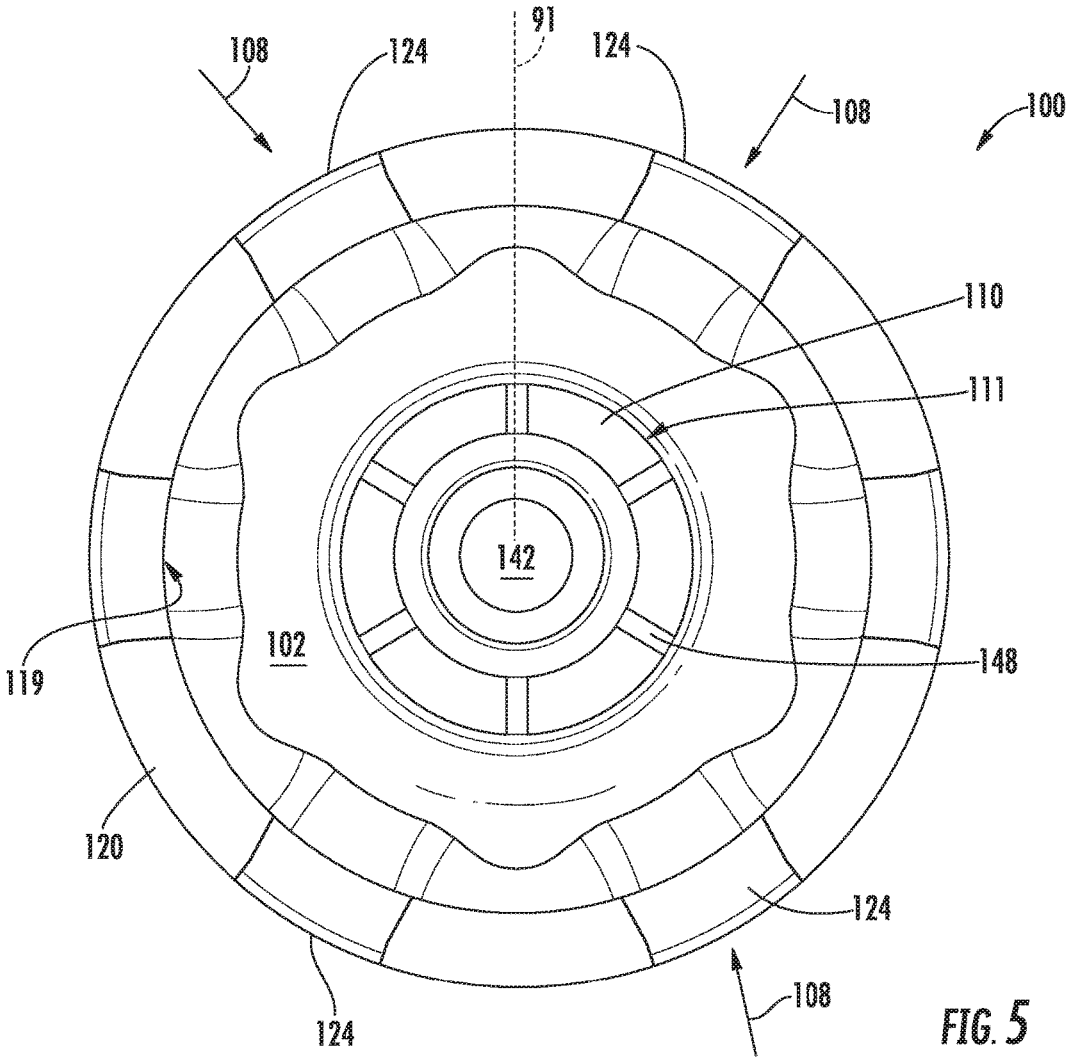
FIG. 5 is a cross sectional view of the exemplary embodiment of the fuel injector shown in FIG. 3 at plane 5-5.

The outer sleeve 120 surrounds the centerbody 110 from the end wall 130 toward the downstream end 98 of the fuel injector 100. The outer sleeve 120 and the centerbody 110 together define a premix passage 102 therebetween and an outlet 104. The centerbody 110 may further define a centerbody surface 111 radially outward of the outer wall 112 and along the premix passage 102. The outer sleeve 120 may further define an outer sleeve surface 119 radially inward of the outer sleeve 120 and along the premix passage 102. The outlet 104 is at the downstream end 98 of premix passage 102 of the fuel injector 100. The outer sleeve 120 defines a plurality of radially oriented first air inlet ports 122 arranged along circumferential direction C (as shown in FIGS. 4-5) at a first axial portion 121 of the outer sleeve 120. The outer sleeve 120 further defines a plurality of radially oriented second air inlet ports 124 arranged along circumferential direction C (as shown in FIGS. 4-5) at a second axial portion 123 of the outer sleeve 120.

Referring still to the exemplary embodiment shown in FIG. 3, the radially oriented fluid injection port 148 is disposed radially inward of the second air inlet port 124. The serial combination of the radially oriented first air inlet port 122, the radially oriented fluid injection port 148, and the radially oriented second air inlet port 124 radially outward of the fluid injection port 148 may provide a compact, non-swirl or low-swirl premixed flame (i.e. shorter length flame) at a higher primary combustion zone temperature (i.e. higher energy output), while meeting or exceeding present emissions standards.

The radially oriented fluid injection port 148 may further define a first outlet port 107 and a second outlet port 109, in which the first outlet port 107 is radially inward of the second outlet port 109. The first outlet port 107 is adjacent to the fluid conduit 142 and the second outlet port 109 is adjacent to the premix passage 102. In the embodiment shown in FIG. 3, each first outlet port 107 is radially inward of or radially concentric to each respective second outlet port 109 along a corresponding axial location. In another embodiment, each first outlet port may be axially eccentric relative to each respective second outlet port. For example, the fluid injection port 148 may define a first outlet port 107 at a first axial location along the centerbody 110 and a second outlet port 109 at a second axial location along the centerbody 110. The fluid injection port 148 may therefore define an acute angle relative to the longitudinal centerline 90. More specifically, the fluid injection port 148 may define an oblique angle relative to the longitudinal centerline 90 of the fuel injector 100 (i.e. not co-linear or parallel, or perpendicular, to the longitudinal centerline 90).

Referring still to FIG. 3, the exemplary embodiment of the fuel injector 100 may further include a shroud 116 disposed at the downstream end 98 of the centerbody 110. The shroud 116 may extend axially from the downstream end 98 of the outer wall 112 of the centerbody 110 toward the combustion chamber 62. The downstream end 98 of the shroud 116 may be approximately in axial alignment with the downstream end 98 of the outer sleeve 120. As shown in FIG. 3, the shroud 116 is annular around the downstream end 98 of the outer wall 112. The shroud 116 may further define a shroud wall 117 radially extended inward of the outer wall 112. The shroud wall 117 protrudes upstream into the centerbody 110. The shroud wall 117 may define a radius that protrudes upstream into the centerbody 110. The upstream end 99 of the shroud wall 117 may be in thermal communication with the fluid conduit 142. The shroud 116 may provide flame stabilization for the no-swirl or low-swirl flame emitting from the fuel injector 100.

In other embodiments of the fuel injector 100, the shroud 116 and the centerbody 110 may define polygonal cross sections. Polygonal cross sections may further include rounded edges or other smoothed surfaces along the centerbody surface 111 or the shroud 116.

The centerbody 110 may further accelerate the fuel-air mixture 72 within the premix passage 102 while providing the shroud 116 as an independent bluff region for anchoring the flame. The fuel injector 100 may define within the premix passage 102 a mixing length 101 from the radially oriented fluid injection port 148 to the outlet 104. The fuel injector 100 may further define within the premix passage 102 an annular hydraulic diameter 103 from the centerbody surface 111 to the outer sleeve surface 119. In one embodiment of the fuel injector 100, the premix passage 102 defines a ratio of the mixing length 101 over the annular hydraulic diameter 103 of about 3.5 or less. Still further, in one embodiment, the annular hydraulic diameter 103 may range from about 7.65 millimeters or less.

In the embodiment shown in FIG. 3, the centerbody surface 111 of the fuel injector 100 extends radially from the longitudinal centerline 90 toward the outer sleeve surface 119 to define a lesser annular hydraulic diameter 103 at the outlet 104 of the premix passage 102 than upstream of the outlet 104. In another embodiment, at least a portion of the outer sleeve surface 119 along the mixing length 101 may extend radially outward of the longitudinal centerline 90. In still other embodiments, the centerbody surface 111 and the outer sleeve surface 119 may define a parallel relationship such that the annular hydraulic diameter 103 remains constant through the mixing length 101 of the premix passage 102. Furthermore, in still other embodiments, the centerbody surface 111 and the outer sleeve surface 199 may define a parallel relationship while extending radially from the longitudinal centerline 90.

Referring now to FIG. 4, a cross sectional view of the exemplary embodiment of the fuel injector 100 of FIG. 3 at plane 4-4 is shown. The fuel injector 100 defines a circumferential direction C and a vertical reference line 91. In the embodiment shown, each first air inlet port 122 induces little or no swirl to a first stream of air 106 entering the premix passage 102. The first air inlet ports 122 may be arranged approximately evenly along circumferential direction C. In the embodiment shown in FIG. 4, the first air inlet ports 122 are positioned approximately at top dead center (TDC), i.e. zero degrees relative to the vertical reference line 91, and evenly spaced therefrom. In other embodiments, the first air inlet ports 122 may be positioned evenly and offset from TDC. For example, the first air inlet ports 122 may be evenly spaced in the circumferential direction C from 15 degrees, or 30 degrees, or 45 degrees, etc. from the vertical reference line 91. In still other embodiments, the first air inlet ports 122 may be unevenly spaced along circumferential direction C. For example, the first air inlet ports 122 may be in asymmetric arrangement along circumferential direction C.

Referring now to FIG. 5, a cross sectional view of the exemplary embodiment of the fuel injector 100 of FIG. 3 at plane 5-5 is shown. In the embodiment shown, each second air inlet port 124 induces little or no swirl to a second stream of air 108 entering the premix passage 102. The second air inlet ports 124 may be arranged approximately evenly along circumferential direction C. In the embodiment shown in FIG. 5, the second air inlet ports 124 are offset from TDC and evenly spaced therefrom. In the embodiment shown in FIG. 5, the second air inlet ports 124 are offset approximately 30 degrees from the vertical reference line 91 and spaced evenly therefrom. In other embodiments, the second air inlet ports 124 are positioned approximately at TDC and evenly spaced therefrom. In still other embodiments, the second air inlet ports 124 may be unevenly spaced along circumferential direction C. For example, the first air inlet ports 122 may be in asymmetric arrangement along circumferential direction C.

Referring still to the exemplary embodiment shown in FIG. 5, the radially oriented fluid injection ports 148 are arranged approximately evenly along circumferential direction C. In the embodiment shown in FIG. 5, the fluid injection ports 148 are positioned at TDC and evenly spaced therefrom. In other embodiments, the fluid injection ports 148 may be unevenly spaced or positioned offset from the vertical reference line 91.

Referring now to the exemplary embodiments shown in FIGS. 4 and 5, the first air inlet ports 122 shown in FIG. 4 are in alignment along circumferential direction C with the fluid injection ports 148 shown in FIG. 5. The second air inlet ports 124, shown in FIG. 5, are offset in the circumferential direction C relative to the vertical reference line 91 from the fluid injection ports 148 and are evenly radially spaced in circumferential direction C between the first air inlet ports 122. In other embodiments of the fuel injector 100 shown in FIGS. 4 and 5, the first and second air inlet ports 122, 124 may be arranged in alignment along circumferential direction C. In still other embodiments, the fluid injection ports 148 may be arranged in alignment with either or both of the first or second air inlet ports 122, 124 along circumferential direction C. In still yet other embodiments, either or all of the first and second air inlet ports 122, 124 and the fluid injection ports 148 may be unevenly spaced along circumferential direction C or in non-alignment relative to one another.

The serial combination of the radially oriented air inlet ports 122, the radially oriented fluid injection ports 148, and the radially oriented second air inlet ports 124 may provide a compact, non-swirl or low-swirl premixed flame at a higher primary combustion zone temperature producing a higher energy combustion with a shorter flame length while maintaining or reducing emissions outputs. Additionally, the non-swirl or low-swirl premixed flame may mitigate combustor instability, lean blow-out (LBO), or hot spots that may be caused by a breakdown or unsteadiness in a larger flame.

In another embodiment, the first or second air inlet ports 122, 124 may induce a clockwise or counterclockwise swirl to the first or second streams of air 106, 108. The first or second air inlet ports 122, 124 may introduce the first or second streams of air 106, 108 at an angle relative to the vertical reference line 91. In one embodiment, the angle may be about 35 to 65 degrees relative to the vertical reference line 91. In another embodiment, the first and second air inlet ports 122, 124 may induce a co-swirling arrangement such that both the first and second streams of air 106, 108 enter the premix passage 102 in a similar circumferential direction. In still another embodiment, the first and second air inlet ports 122, 124 may induce a counter-swirling arrangement such that the first and second streams of air 106, 108 enter the premix passage 102 in opposing circumferential directions. For example, the first air inlet port 122 may define an angle of about 35 to 65 degrees and the second air inlet port 124 may define an angle of about −35 to −65 degrees relative to the vertical reference line 91. In still yet another embodiment, the first air inlet port 122 may induce a clockwise swirl and the second air inlet port 124 may induce a counterclockwise swirl. In other embodiments, the first air inlet port 122 may induce a counterclockwise swirl and the second air inlet port 124 may induce a clockwise swirl.

Referring still to the fuel injector 100 shown in FIG. 5, each first outlet port 107 is in alignment along circumferential direction C relative to a respective second outlet port 109. More specifically, each first outlet port 107 is radially inward of or radially concentric to each respective second outlet port 109 along a corresponding circumferential location. For example, for the fluid injection port 148 located at TDC, the first and second outlet ports 107, 109 are each radially concentric and positioned at TDC (i.e. zero degrees relative to the vertical reference line 91). In another embodiment, the first outlet port 107 may be radially eccentric relative to a respective second outlet port 109. For example, the fluid injection port 148 may define the first outlet port 107 at zero degrees relative to the vertical reference line 91 and the respective second outlet port 109 may be at another angular location (i.e. greater or lesser than zero degrees relative to the vertical reference line 91) relative to the vertical reference line 91.

Figure 6:
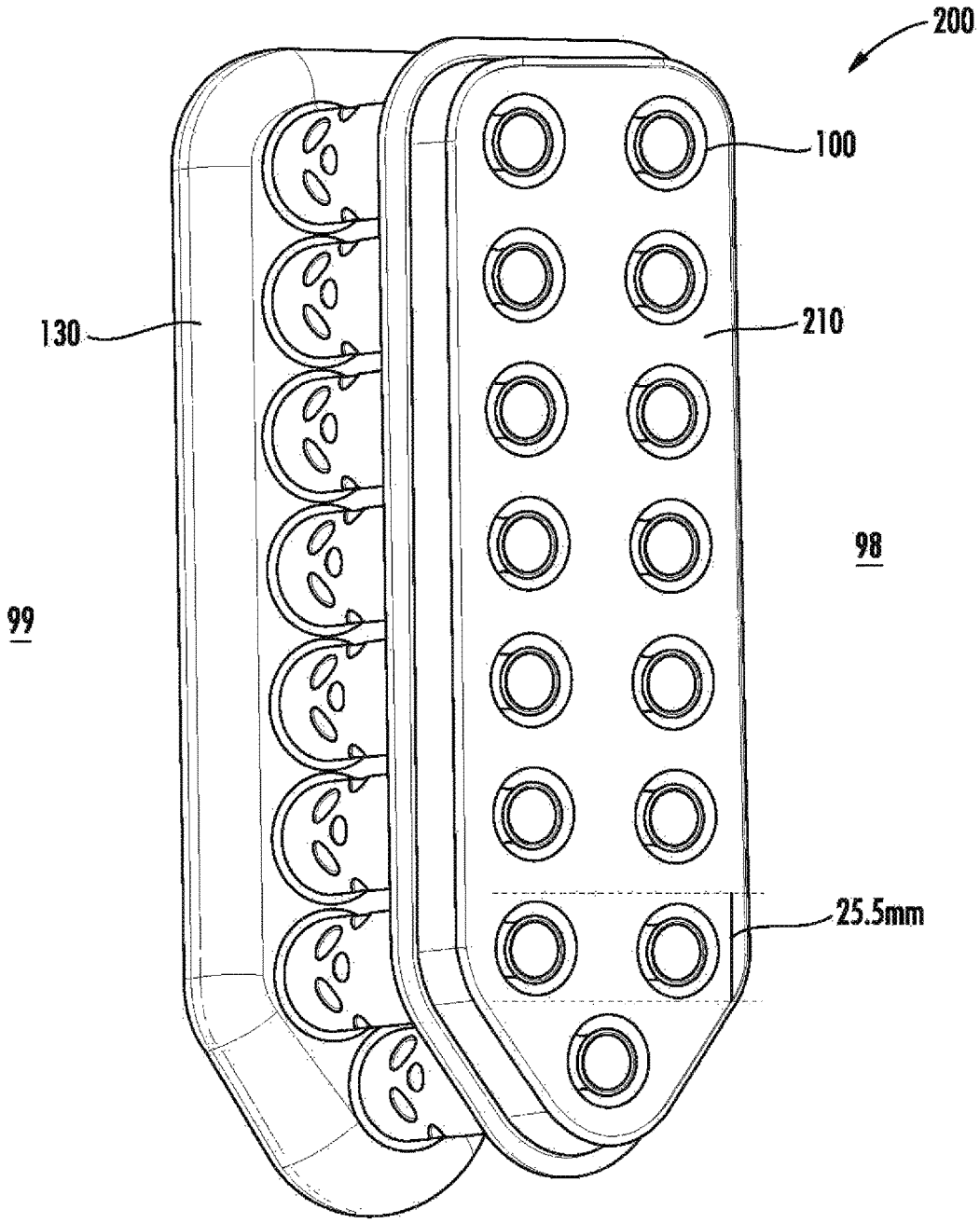
FIG. 6 is a perspective view of an exemplary fuel nozzle including a plurality of the exemplary fuel injectors shown in FIG. 2.

Referring now to FIG. 6, a perspective view of an exemplary embodiment of a fuel nozzle 200 is shown. The fuel nozzle 200 includes an end wall 130, a plurality of fuel injectors 100, and an aft wall 210. The plurality of fuel injectors 100 may be configured in substantially the same manner as described in regard to FIGS. 3-5. However, the end wall 130 of the fuel nozzle 200 defines at least one fluid chamber 132 and at least one fluid plenum 134, each in fluid communication with the plurality of fuel injectors 100. The aft wall 210 is connected to the downstream end 98 of the outer sleeve 120 of each of the plurality of fuel injectors 100. The fuel nozzle 200 defines a ratio of at least one fuel injector 100 per about 25.5 millimeters extending radially from the engine centerline 12. The fuel nozzle 200 further includes at least one pilot fluid sleeve 230 extended from the end wall 130 and disposed between an outer surface 231 of the outer sleeve 120 of a plurality of fuel injectors 100. The pilot fluid sleeve 230 defines a pilot fluid injection port 234 at the aft wall 210 of the fuel nozzle 200.

Figure 7:
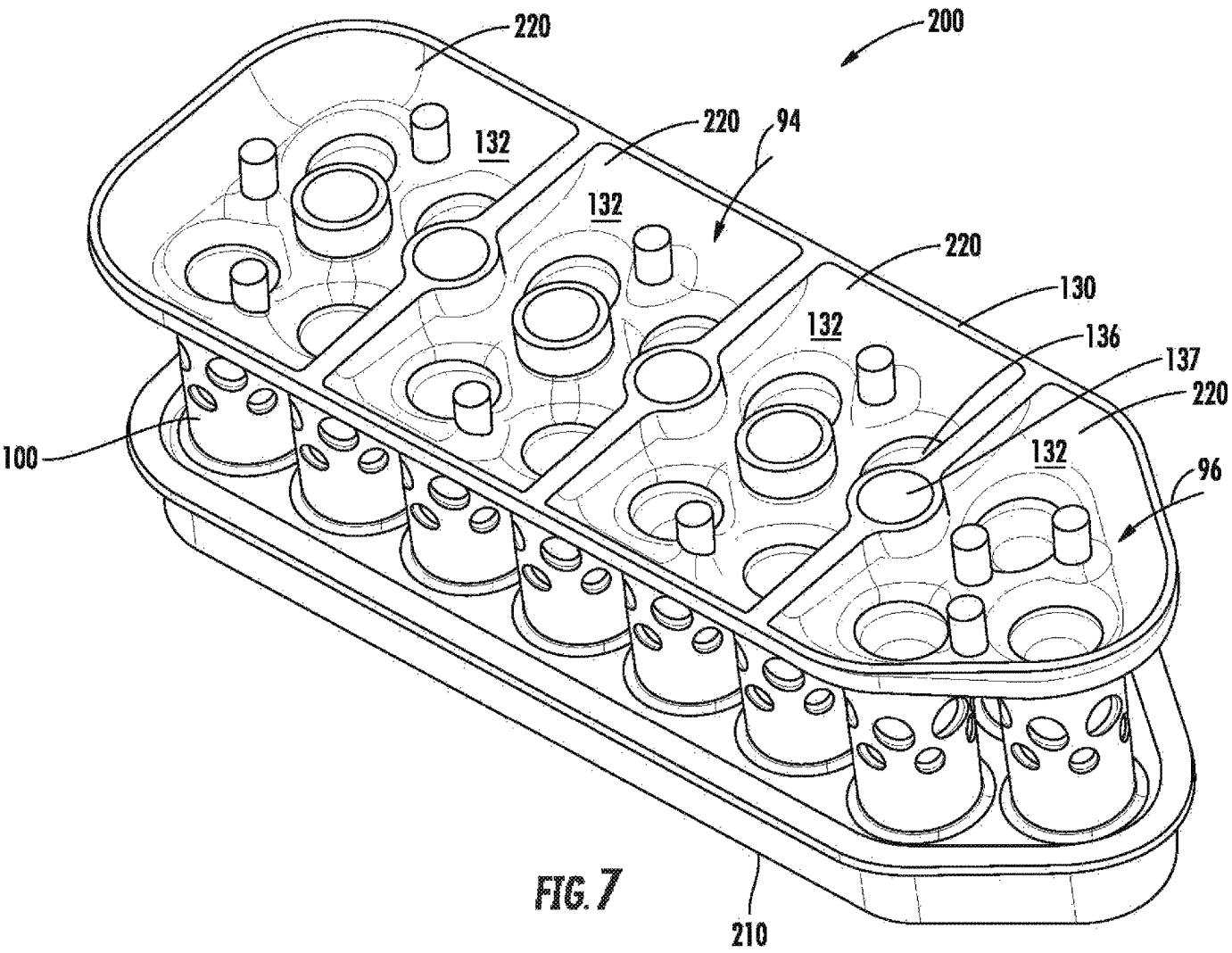
FIG. 7 is a cutaway perspective view of the end wall of the exemplary fuel nozzle shown in FIG. 6.

Referring now to FIG. 7, a cutaway perspective view of the end wall 130 of the exemplary embodiment of the fuel nozzle 200 of FIG. 6 is shown. FIG. 8 shows a cutaway view of the end wall 130 and a plurality of fluid chambers 132. The fuel nozzle 200 may define a plurality of independent fluid zones 220 to independently and variably articulate a fluid 94 into each fluid chamber 132 for each fuel nozzle 200 or plurality of fuel nozzles 200 within the combustor assembly 50. Independent and variable controllability includes setting and producing fluid pressures, temperatures, flow rates, and fluid types through each fluid chamber 132 separate from another fluid chamber 132. The fluid 94 may include a gaseous or liquid fuel, or air, or an inert gas, or combinations thereof.

In the embodiment shown in FIG. 7, each independent fluid zone 220 may define separate fluids, fluid pressures and flow rates, and temperatures for the fluid through each fuel injector 100. In another embodiment, the independent fluid zones 220 may define different fuel injector 100 structures within each independent fluid zone 220. For example, the fuel injector 100 in a first independent fluid zone 220 may define different radii or diameters from a second independent fluid zone 220 within the first and second air inlet ports 122, 124 or the premix passage 102. In still another embodiment, a first independent fluid zone 220 may define features within the fuel injector 100, including the fluid chamber 132 or the fluid plenum 134, that may be suitable as a pilot fuel injector, or as an injector suitable for altitude light off (i.e. at altitudes from sea level up to about 16200 meters).

The independent fluid zones 220 may further enable finer combustor tuning by providing independent control of fluid pressure, flow, and temperature through each plurality of fuel injectors 100 within each independent fluid zone 220. Finer combustor tuning may further mitigate undesirable combustor tones (i.e. thermo-acoustic noise due to unsteady or oscillating pressure dynamics during fuel-air combustion) by adjusting the pressure, flow, or temperature of the fluid through each plurality of fuel injectors 100 within each independent fluid zone 220. Similarly, finer combustor tuning may prevent lean blow-out (LBO), promote altitude light off, and reduce hot spots (i.e. asymmetric differences in temperature across the circumference of a combustor that may advance turbine section deterioration). While finer combustor tuning is enabled by the magnitude of the plurality of fuel injectors 100, it is further enabled by providing independent fluid zones 220 across the radial distance of each fuel nozzle 200.

Referring still to FIG. 7, the end wall 130 of the fuel nozzle 200 may further define at least one fuel nozzle air passage wall 136 extending through the fuel nozzle 200 and disposed radially between a plurality of fuel injectors 100. The fuel nozzle air passage wall 136 defines a fuel nozzle air passage 137 to distribute air to a plurality of fuel injectors 100. The fuel nozzle air passage 137 may distribute air to at least a portion of each of the first and second air inlet ports 122, 124.

The fuel injector 100 and fuel nozzle 200 shown in FIGS. 1-7 and described herein may be constructed as an assembly of various components that are mechanically joined or as a single, unitary component and manufactured from any number of processes commonly known by one skilled in the art. These manufacturing processes include, but are not limited to, those referred to as "additive manufacturing" or 3D printing". Additionally, any number of casting, machining, welding, brazing, or sintering processes, or mechanical fasteners, or any combination thereof, may be utilized to construct the fuel injector 100, the fuel nozzle 200, or the combustor assembly 50. Furthermore, the fuel injector 100 and the fuel nozzle 200 may be constructed of any suitable material for turbine engine combustor sections, including but not limited to, nickel- and cobalt-based alloys. Still further, flowpath surfaces, such as, but not limited to, the fluid chamber 132, the fluid conduit 142, the fluid injection ports 148, the first or second air inlet ports 122, 124, the centerbody surface 111 or outer sleeve surface 119 of the premix passage 102 may include surface finishing or other manufacturing methods to reduce drag or otherwise promote fluid flow, such as, but not limited to, tumble finishing, barreling, rifling, polishing, or coating.

The plurality of centerbody injector mini mixer fuel injectors 100 arranged within a ratio of at least one per about 25.5 millimeters extending radially along the fuel nozzle 200 from the engine centerline 12 may produce a plurality of well-mixed, compact non- or low-swirl flames at the combustion chamber 62 with higher energy output while maintaining or decreasing emissions. The plurality of fuel injectors 100 in the fuel nozzle 200 producing a more compact flame and mitigating strong-swirl stabilization may further mitigate combustor tones caused by vortex breakdown or unsteady processing vortex of the flame. Additionally, the plurality of independent fluid zones may further mitigate combustor tones, LBO, and hot spots while promoting higher energy output, lower emissions, altitude light off, and finer combustion controllability.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel injector for a gas turbine engine, the fuel injector comprising:

an end wall defining a fluid chamber;

a centerbody comprising an axially extended outer wall and inner wall, wherein the outer wall and inner wall extend from the end wall toward a downstream end of the fuel injector, and wherein the outer wall, the inner wall, and the end wall together define a fluid conduit extended in a first direction toward the downstream end of the fuel injector and in a second direction toward an upstream end of the fuel injector, the fluid conduit being in fluid communication with the fluid chamber, and wherein the outer wall defines at least one radially oriented fluid injection port in fluid communication with the fluid conduit;

an outer sleeve surrounding the centerbody from the end wall toward the downstream end of the fuel injector, wherein the outer sleeve and the centerbody define a premix passage radially therebetween and an outlet at the downstream end of the premix passage, and wherein the outer sleeve defines a plurality of radially oriented first air inlet ports in circumferential arrangement at a first axial portion of the outer sleeve, and wherein the outer sleeve defines a plurality of radially oriented second air inlet ports in circumferential arrangement at a second axial portion of the outer sleeve.

2. The fuel injector of claim 1, the fuel injector further comprising:

a shroud disposed at the downstream end of the centerbody, wherein the shroud extends axially from the downstream end of the outer wall of the centerbody, and wherein the shroud is annular around the downstream end of the outer wall.

3. The fuel injector of claim 2, wherein the shroud further includes a shroud wall extended radially inward of the outer wall, wherein the shroud wall protrudes upstream into the centerbody.

4. The fuel injector of claim 1, wherein a mixing length is defined within the premix passage from the fluid injection port to the outlet of the premix passage, and wherein a centerbody surface and an outer sleeve surface define an annular hydraulic diameter.

5. The fuel injector of claim 4, wherein a ratio of the mixing length over the annular hydraulic diameter is about 3.5 or less.

6. The fuel injector of claim 4, wherein the annular hydraulic diameter is about 7.65 millimeters or less.

7. The fuel injector of claim 4, wherein the centerbody surface extends radially from the longitudinal centerline toward the outer sleeve surface to define a lesser annular hydraulic diameter at the outlet of the premix passage than upstream of the outlet.

8. The fuel injector of claim 4, wherein at least a portion of the outer sleeve surface along the mixing length extends radially outward of the longitudinal centerline.

9. The fuel injector of claim 4, wherein the centerbody surface and the outer sleeve surface define a parallel relationship such that the annular hydraulic diameter remains constant through the mixing length of the premix passage.

10. The fuel injector of claim 1, wherein the centerbody further defines a first outlet port and a second outlet port of the radially oriented fluid injection port, wherein the first outlet port is radially inward of the second outlet port, and wherein the first outlet port is adjacent to the fluid conduit and the second outlet port is adjacent to the premix passage.

11. The fuel injector of claim 10, wherein each first outlet port is radially eccentric relative to each respective second outlet port.

12. The fuel injector of claim 10, wherein each first outlet port is axially eccentric relative to each respective second outlet port.

13. The fuel injector of claim 10, wherein each first outlet port is radially concentric to each respective second outlet port along a corresponding axial location.

14. The fuel injector of claim 1, wherein the first air inlet ports are in alignment along the circumferential direction with the fluid injection ports, and wherein the second air inlet ports are offset in the circumferential direction from the first air inlet ports relative a vertical reference line.

15. A fuel nozzle for a gas turbine engine, the fuel nozzle comprising:

an end wall defining a fluid chamber;

a plurality of fuel injectors in axially and radially adjacent arrangement, wherein each fuel injector comprises:

a centerbody comprising an axially extended outer wall and inner wall, wherein the outer wall and inner wall extend from the end wall toward a downstream end of the fuel injector, and wherein the outer wall, the inner wall, and the end wall together define a fluid conduit extended in a first direction toward the downstream end of the fuel injector and in a second direction toward an upstream end of the fuel injector, the fluid conduit in fluid communication with the fluid chamber, and wherein the centerbody defines at least one radially oriented fluid injection port in fluid communication with the fluid conduit;

an outer sleeve surrounding the centerbody from the end wall toward the downstream end of the fuel injector, wherein the outer sleeve and the centerbody define a premix passage radially therebetween and an outlet at the downstream end of the premix passage, and wherein the outer sleeve defines a plurality of radially oriented first air inlet ports in circumferential arrangement at a first axial portion of the outer sleeve, and wherein the outer sleeve defines a plurality of radially oriented second air inlet ports in circumferential arrangement at a second axial portion of the outer sleeve; and an aft wall, wherein the downstream end of the outer sleeve of each fuel injector is connected to the aft wall.

16. The fuel nozzle of claim 15, wherein the fuel nozzle defines a ratio of one fuel injector per about 25.5 millimeters extending radially from an engine centerline.

17. The fuel nozzle of claim 15, wherein the fuel nozzle defines a plurality of independent fluid zones, and wherein the independent fluid zones independently articulates a fluid into each fluid chamber of the end wall.

18. The fuel nozzle of claim 15, further comprising:

a fuel nozzle air passage wall extending axially through the fuel nozzle and disposed radially between a plurality of fuel injectors, wherein the fuel nozzle air passage wall defines a fuel nozzle air passage to distribute air to a plurality of fuel injectors.

19. A combustor assembly for a gas turbine engine, the combustor assembly comprising:

an inner liner;

an outer liner;

a bulkhead extended radially between an upstream end of the inner liner and the outer liner, wherein the inner liner is radially spaced from the outer liner with respect to an engine centerline and defining an annular combustion chamber therebetween, and wherein the inner liner and the outer liner extend downstream from the bulkhead; and at least one fuel nozzle extended at least partially through the bulkhead, wherein the fuel nozzle includes an end wall defining a fluid chamber, a plurality of fuel injectors in axially and radially adjacent arrangement, and an aft wall wherein the downstream end of the outer sleeve of each fuel injector is connected to the aft wall, and wherein each fuel injector includes a centerbody and an outer sleeve surrounding the centerbody from the end wall toward the downstream end of the fuel injector, wherein the centerbody comprises an axially extended outer wall and inner wall, wherein the outer wall and inner wall extend from the end wall toward a downstream end of the fuel injector, and wherein the outer wall, the inner wall, and the end wall together define a fluid conduit extended in a first direction toward the downstream end of the fuel injector and in a second direction toward an upstream end of the fuel injector, the fluid conduit in fluid communication with the fluid chamber, and wherein the centerbody defines at least one radially oriented fluid injection port in fluid communication with the fluid conduit, and wherein the outer sleeve and the centerbody define a premix passage radially therebetween and an outlet at the downstream end of the premix passage, and wherein the outer sleeve defines a plurality of radially oriented first air inlet ports in circumferential arrangement at a first axial portion of the outer sleeve, and wherein the outer sleeve defines a plurality of radially oriented second air inlet ports in circumferential arrangement at a second axial portion of the outer sleeve.

20. A gas turbine engine comprising the combustor assembly of claim 19.

* * * * *